US005833282A

United States Patent [19]

Ikeda

[11] Patent Number: 5,833,282

[45] Date of Patent: Nov. 10, 1998

[54] DOOR LOCKING DEVICE WITH AN ANTITHEFT MECHANISM

[75] Inventor: Takao Ikeda, Tochigi-ken, Japan

[73] Assignee: Mitsui Kinzoku Kogyo Kabushiki Kaisha, Tokyo, Japan

[21] Appl. No.: 816,569

[22] Filed: Mar. 13, 1997

Related U.S. Application Data

[63] Continuation of Ser. No. 249,925, May 26, 1994.

[30] Foreign Application Priority Data

May 28, 1993 [JP] Japan ..... 5-151439

[51] Int. Cl.[6] ..... E05C 3/06

[52] U.S. Cl. ..... 292/201; 292/216; 292/144; 70/264

[58] Field of Search ..... 70/264, 277–282, 70/237–240; 292/201, 216, 144, 280, 341.16, DIG. 26, DIG. 27

[56] References Cited

U.S. PATENT DOCUMENTS

| | | | |
|---|---|---|---|
| 4,364,249 | 12/1982 | Kleefeldt | 70/264 |
| 4,538,845 | 9/1985 | Yamada | 292/216 |
| 4,685,709 | 8/1987 | Kambic | 70/279 X |
| 4,932,277 | 6/1990 | Beaux | 292/201 X |
| 4,974,886 | 12/1990 | Kleefeldt et al. | 292/201 |
| 4,978,154 | 12/1990 | Kleefeldt et al. | 292/201 |
| 5,066,054 | 11/1991 | Ingenhoven | 292/201 |
| 5,072,975 | 12/1991 | Hamada et al. | 292/201 |
| 5,146,772 | 9/1992 | Hamada et al. | 70/264 |
| 5,277,461 | 1/1994 | Dzurko et al. | 292/216 |
| 5,348,357 | 9/1994 | Konchan et al. | 292/216 |
| 5,419,597 | 5/1995 | Brackmann et al. | 292/201 |
| 5,438,855 | 8/1995 | Ikeda | 292/201 X |
| 5,439,261 | 8/1995 | O'Hare | 292/201 X |
| 5,615,564 | 4/1997 | Inoue | 70/279 |

FOREIGN PATENT DOCUMENTS 2276194 9/1994 United Kingdom .

*Primary Examiner*—Suzanne Dino
*Attorney, Agent, or Firm*—Browdy and Neimark

[57] ABSTRACT

A door locking device with an antitheft mechanism comprises a main locking lever connected to a key cylinder and, for changing over the locking device to a locking state or to an unlocking state, a sub locking lever connected to an inside lock button of the door, a connector provided between the locking levers, always linked with the main locking lever and changed over to a normal position where it is linked with the sub locking lever and to an antitheft position where it is not linked therewith, an output member which is turned by the motor and is linked with the main locking lever, and a guide wall provided in the vicinity of the connector. The guide wall is engageable with the connector as the connector is displaced by unlocking rotation of the main locking lever in order to displace the connector from the antitheft position to the normal position.

8 Claims, 9 Drawing Sheets

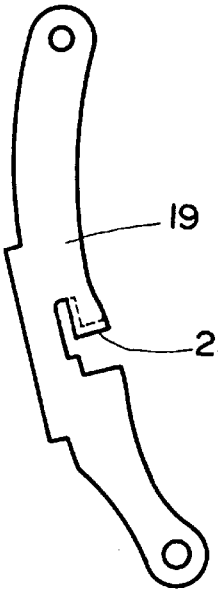
FIG. 8
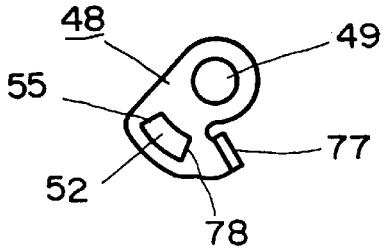
FIG. 9
FIG. 10
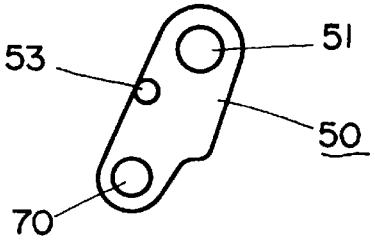
FIG. 11
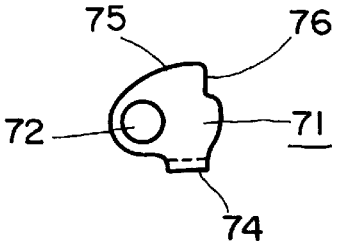
FIG. 13
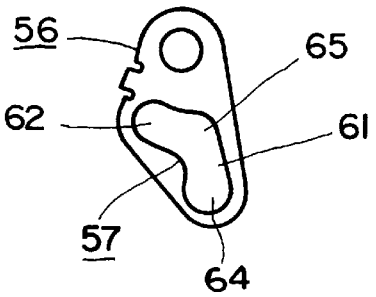
FIG. 12
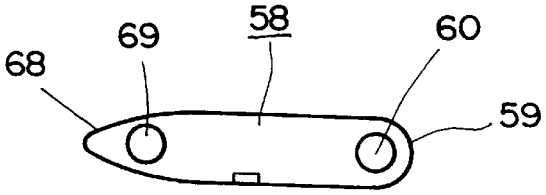

DOOR LOCKING DEVICE WITH AN ANTITHEFT MECHANISM

This application is a continuation of application Ser. No. 08/249,925 filed May 26, 1994.

FIELD OF THE INVENTION

The present invention relates to a door locking device, and more particularly relates to a door locking device with an antitheft mechanism.

PRIOR ART

According to a door locking device of an already known prior art, a door is locked and unlocked by a key cylinder attached outside the door or a lock button inside the door. In order to cancel the locking state of a locking device from outside the vehicle body, a key corresponding to the key cylinder is usually needed. However, a thief may cancel the locking state by directly operating the inside lock button by breaking a window.

In order to cope with such an unjust operation, U.S. Pat. No. 4,978,154 which is already known to the public proposed a locking device having an antitheft mechanism which can stop the function of the inside lock buttons. As shown in FIG. 23, the locking device is provided with a main lock lever A linked with the key cylinder of the door, which can change over the locking device to the locking state and unlocking state; a sub locking lever C linked with the inside lock button B of the door; a connector D which is installed between the main lock lever A and the sub lock lever C and is displaceable between the antitheft position in which the rotation of the sub lock lever C is not transmitted to the main lock lever A and the normal position or antitheft cancelling position where both the lock levers are connected; a change lever E which changes over the connector D; an output member G which is displaced by a motor F and is linked with the main lock lever A; and a dowel H which is displaced by the motor F and causes the change lever E to be displaced. When the motor F rotates, the output member G and dowel H move from the unlocking state to the locking state, thereby causing both the locking levers A and C to be displaced to the locking state. When the motor F further rotates for locking, only the dowel H is independently displaced to the antitheft position, thereby causing the connector D to move to the antitheft position, and the linkage of both the locking levers A and C is cancelled. In this antitheft state, even though the sub locking lever C is caused to turn by the locking button B, the locking device will not be able to be turned into the unlocking state.

The first problem of the above known device exists in the displacement of the dowel H from the unlocking position to the antitheft position via the locking position. As the locking position is between the unlocking position and the antitheft position, the output member G and dowel H must be caused to stop at the locking position without fail and must not move further beyond the locking position when the locking device is changed over to the locking state by the motor F. For this reason, the above known device is provided, in the vicinity of the output member G, with a switch I which is able to stop the motor F by detecting that the output member G enters the locking position. Actually however, as it is impossible to detect the locking position of the output member G if the switch I should be out of order, the motor F will continuously rotate until the dowel H reaches the antitheft position. In other words, if the switch I is out of order, it will be impossible to change over to the locking state with the motor F. And as the dowel H moves farther by only the distance between the locking position and the antitheft position than the output member G moves, it is necessary to make the motor casing larger to match the distance therebetween.

Furthermore, the second problem of the already known device exists in the configuration by which the connector D is reset from the antitheft position to the normal position. The printed specification of U.S. Pat. No. 4,978,154 is lacking in the description in relation to the problem, and the applicant's understanding of this point is not sufficient. It seems that, even though the key cylinder is caused to turn to unlock in a case where the motor F is out of order in the antitheft position, it is impossible for the connector D to be reset to the normal position. Namely, when the key cylinder is caused to turn to unlock, the main lock lever A moves to the unlocking position. However, at this time, as the output member G moves alone to the unlocking position with the dowel H left, the connector D remains at the antitheft position and does not move. As a result, the function of the locking button B will be lost.

SUMMARY OF THE INVENTION

It is therefore an object of the invention to conquer the problems by rendering the output member, which is caused to turn by a motor, rotatable between the locking position and the unlocking position, and composing so that the locking device turns in the locking state with the first turning of the output member for locking and the antitheft mechanism turns in the antitheft state with the second turning thereof for locking.

It is another object of the invention to provide, with simple configuration, a door locking device with an antitheft mechanism, which can securely cancel the antitheft state of the antitheft mechanism.

It is still another object of the invention to provide a small-sized and highly versatile actuator unit with an antitheft mechanism, by integrally incorporating an antitheft mechanism in an actuator unit casing.

BRIEF DESCRIPTION OF THE DRAWINGS

Other features and advantages of the invention will be apparent from the following description taken in connection with the accompanying drawings wherein:

FIG. 8 is a view showing a lock link, FIG. 9 is a view showing a rotating lever, FIG. 10 is a view showing a link, FIG. 11 is a view showing a change member, FIG. 12 is a view showing a connector, FIG. 13 is a view showing an intermediate lever.

PREFERRED EMBODIMENT OF THE INVENTION

Figure 5:
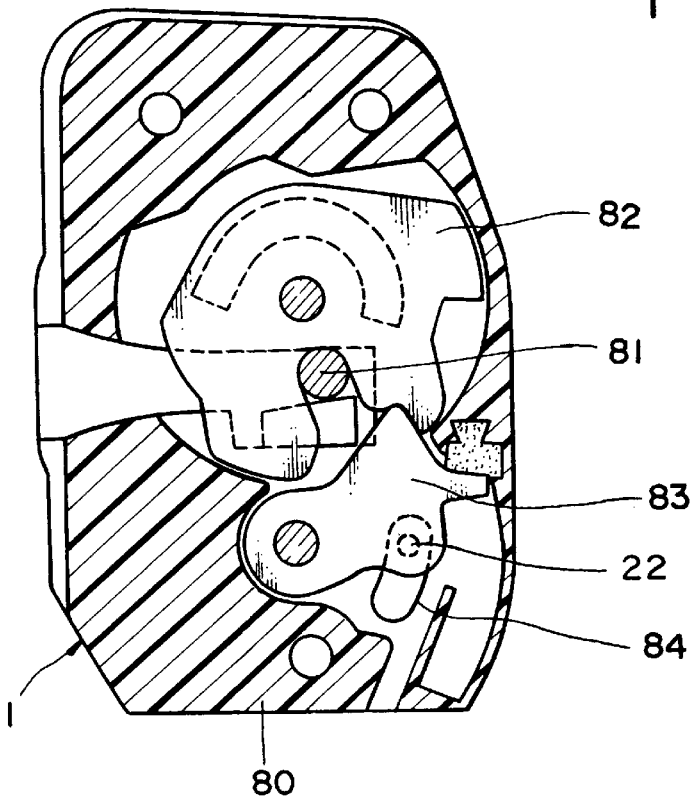
FIG. 5 is a front elevational view of a lock body.
Figure 7:
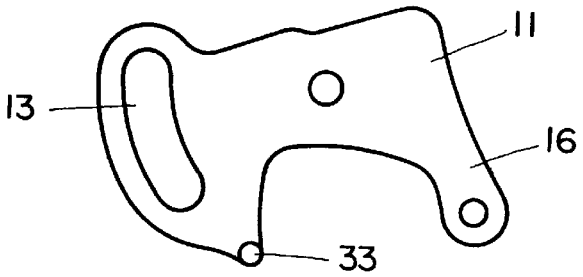
FIG. 7 is a view showing the main lock lever.

A preferred embodiment of the invention will be described with reference to the drawings attached hereto. A locking device according to the invention has a lock unit 1 and an actuator unit 2 attached to the lower part of the lock unit. As shown in FIG. 5, a latch 82 engageable with a striker 81 fixed at the vehicle body and a ratchet 83 engageable with the latch 82 and to retain the engagement of the latch 82 with the striker 81 are accommodated at the front side of a lock body 80 of the lock unit 1. The ratchet 83 has a ratchet pin 22 which protrudes to the rear side of the body 80 via a through hole 84 of the body 80.

Figure 1:
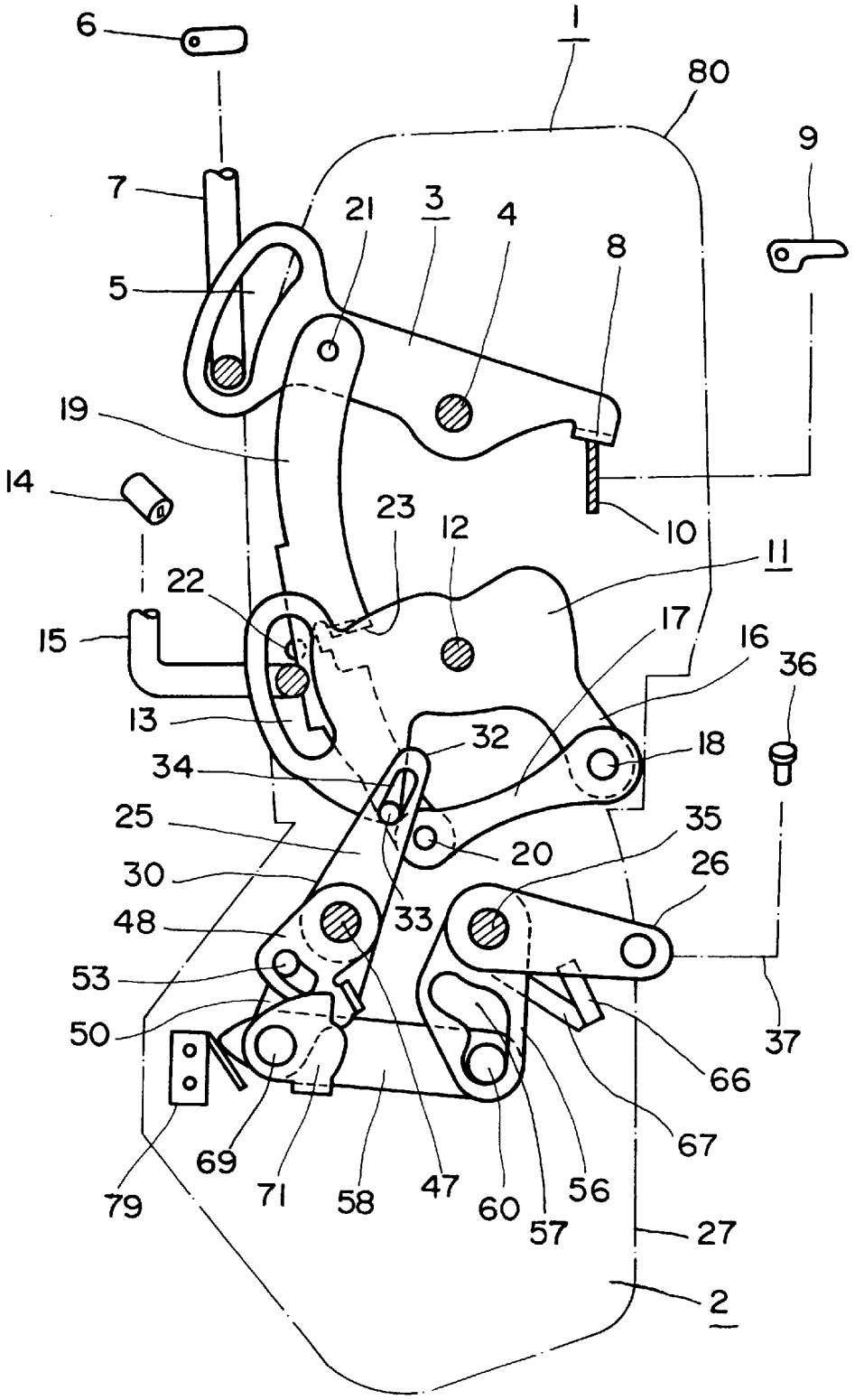
FIG. 1 is an arrangement view of a group of levers in the locked state.
Figure 2:
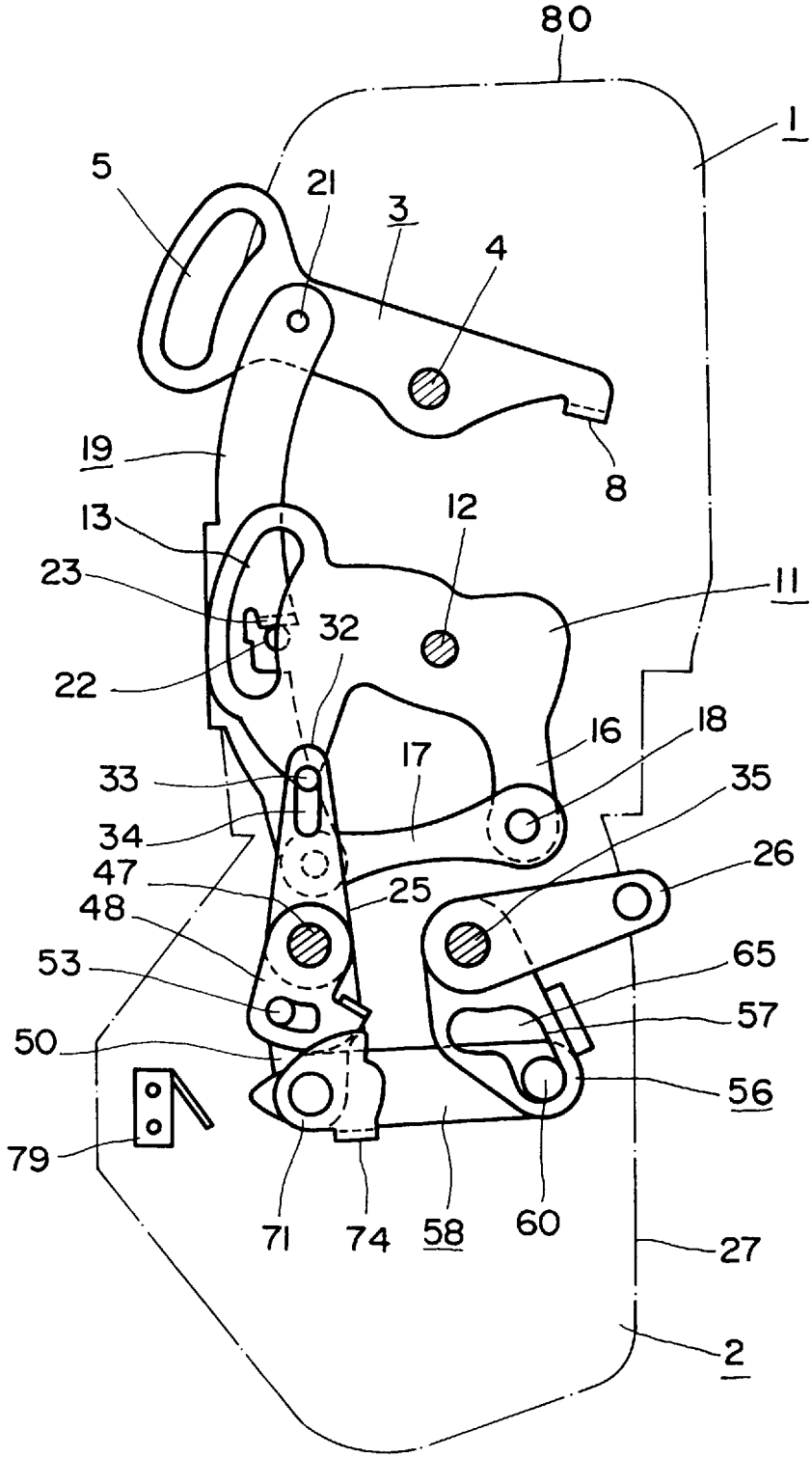
FIG. 2 is an arrangement view of a group of levers in the unlocked state.

As illustrated in FIGS. 1 and 2, an opening lever 3 is pivotally fixed at an axis 4 at the rear side of the lock unit 1. A long slot 5 is formed at the left end side of the opening lever 3, and an edge portion of a rod 7 extending to an outer opening handle 6 installed outside the vehicle door is engaged with the long slot 5. An engaging portion 8 is formed at the right end of the opening lever 3, and an inner lever 10 which is turned by an inner opening handle 9 installed inside the door is faced to the engaging portion 8.

A main lock lever 11 is pivotally fixed at an axis 12 downwards of the opening lever 3 at the rear side of the lock unit 1. An arcuate slot 13 is formed, centering around the axis 12, at the left end of the lock lever 11. A bent portion of a rod 15 extending from an key cylinder 14 of the door is engaged with the arcuate slot 13. An arm 16 extending downwards is formed at the right side of the main lock lever 11. One end of a connector 17 is linked with the leading edge of the arm 16, by a pin 18. The connector 17 is installed roughly horizontally. A lower end of a longitudinal lock link 19 is linked with the left end of connector 17 by a pin 20. The upper end of the link 19 is pivotally fixed at the opening lever 3 by a pin 21.

The main lock lever 11 is displaceable from or to the locking position shown in FIG. 1 and from or to the unlocking position shown in FIG. 2. The lock link 19 is displaced with the displacement of the main lock lever 11. In the unlocked state, as the link 19 is moved downwards by the turning of the opening lever 3, an engaging piece 23 of the link 19 is engaged with the ratchet pin 22 to cause the ratchet 83 to be turned. Thereafter, it is possible to open the door. But when in the locked state, even though the link is moved downwards, the engaging piece 23 is spaced apart from the ratchet pin 22 and can not be engaged therewith, therefore precluding opening of the door.

Figure 3:
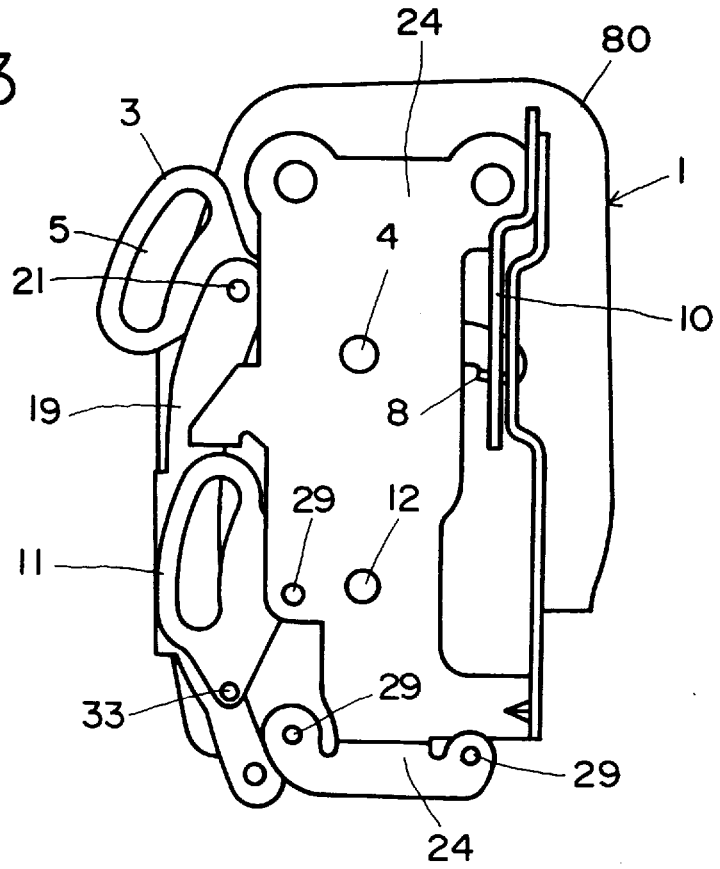
FIG. 3 is a rear elevational view of the lock unit.

As illustrated in FIG. 3, a sheet metal back plate 24 which covers roughly the entirety of the rear side is provided at the rear side of the body 80. A plurality of holes 28 are formed in a synthetic resin casing 27 of the actuator unit 2, and the holes 28 are, respectively, matched with a plurality of holes 29 formed at the back plate 24. Then, screws (not illustrated) are made to pass through these holes in order to fix the casing 27 on the plate 24.

Figure 6:
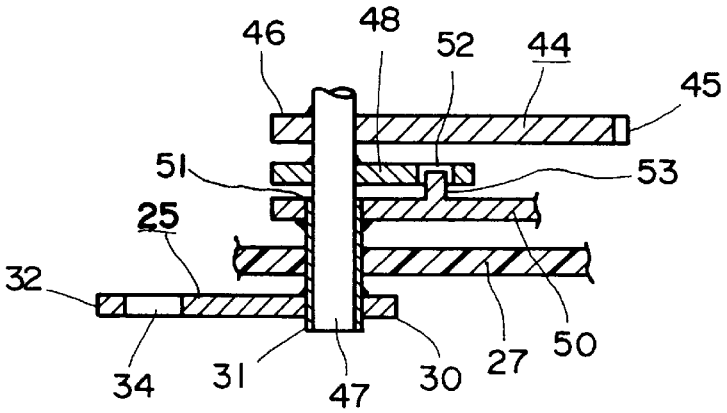
FIG. 6 is a partially notched sectional view of the actuator unit.

As shown in FIGS. 1 and 2, the casing 27 is shown with hypothetical lines, and the inner components thereof are shown with solid lines. Two shafts protrude outwards from the casing 27. One of the shafts is, as shown in FIG. 6, an output cylinder 31 which surrounds a shaft 47. The output cylinder 31 protrudes rearwards of the casing 27. Furthermore, in FIG. 6, the shaft 47 also protrudes outwards of the casing 27 in order to provide strength to support the output cylinder 31. The other shaft is a support shaft 35 attached in parallel to the shaft 47, and the support shaft 35 protrudes frontward of the casing 27.

An output arm 25 is fixed at the protruding end of the output cylinder 31. A pin 33 formed at the main lock lever 11 is engaged with a slot 34 of the output arm 25, thereby causing the output cylinder 31 and the main lock lever 11 to rotate in interlock with each other. A sub lock lever 26 is fixed at the protruding end of the support shaft 35 and is linked via a rod 37 with a lock button or lever 36 provided inside the door.

Figure 4:
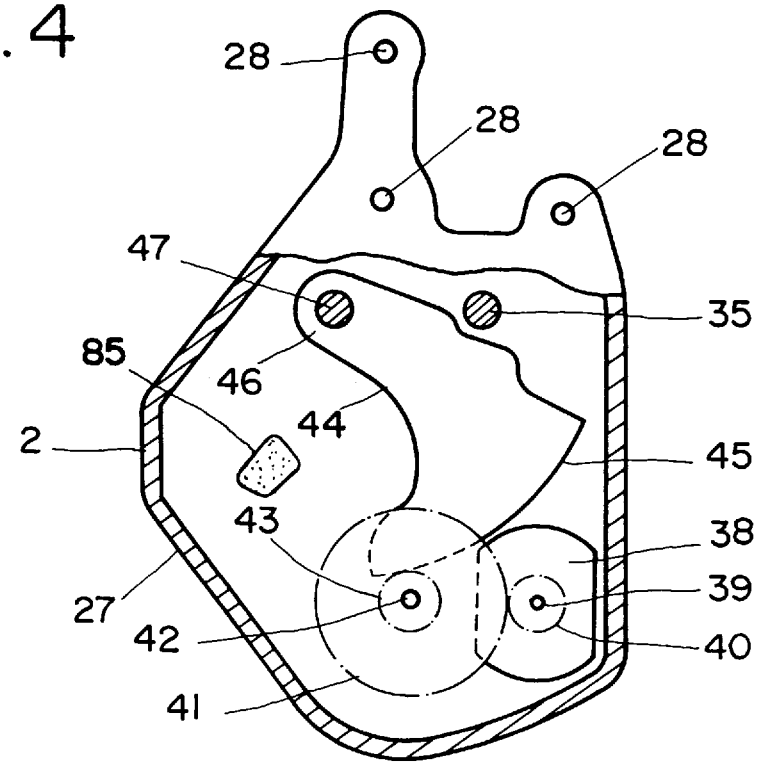
FIG. 4 is a rear elevational view showing a reduction gears mechanism of the actuator unit.

In FIG. 4, an electric motor 38 is mounted inside the casing 27, and a gear 40 is fixed at a drive shaft 39 of the motor 38. A large diametered gear 41 is caused to engage with the gear 40, and a small diametered gear 43 is attached to a rotating shaft 42 of the gear 41. Then, the gear 43 is caused to engage with a gear portion 45 formed at an outer circumferential portion of a sector-like output member 44. Although not illustrated, it is preferable that the gear 43 is attached via a known clutch mechanism to the rotating shaft 42. The clutch mechanism is such that the force of the rotating shaft 42 is transmitted to the gear 43 but the force of the gear 43 is not transmitted to the rotating shaft 42. A base 46 of the output member 44 is fixed at the center shaft 47. A rubber stopper 85 brings into contact with the output member 44 when the output member 44 turns to the locking position.

Figure 14:
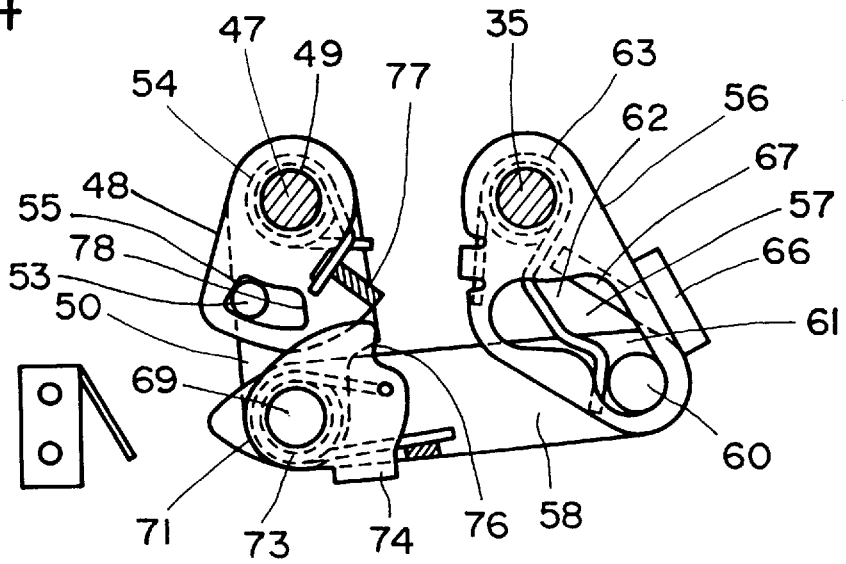
FIG. 14 is an arrangement view of a group of levers in the unlocked state.

Although omitted in FIG. 4, the components shown in FIG. 9 to FIG. 13 are attached in the casing 27. These components are assembled as shown in FIG. 14. The center shaft 47 is inserted through the axis hole 49 of the rotating lever 48 and fixed therein. For this reason, as the output member 44 is rotated by the motor 38, the rotating lever 48 also rotates via of the shaft 47. Furthermore, as the output cylinder 31 rotatably encloses the shaft 47, the cylinder 31 does not directly rotate even though the shaft 47 rotates.

A link 50 is provided so as to be piled together with a rotating lever 48. The link 50 has an axis hole 51 fixed on the output cylinder 31 (Refer to FIG. 6). An arcuate hole 52 centering around the axis hole 49 is formed at the rotating lever 48, and a projection 53 formed on the link 50 is linked with the arcuate hole 52 with a lost-motion. A spring 54 is placed between the link 50 and the rotating lever 48, thereby causing the rotating lever 48 to be energy-charged counter-clockwise due to elasticity of the spring 54. Therefore, when the motor 38 is caused to turn off, the rotating lever 48 is maintained in such a state that a left end 55 of the arcuate hole 52 is in contact with the projection 53. The link 50 rotates clockwise or counterclockwise by engagement of the arcuate hole 52 with the projection 53 as the rotating lever 48 is rotated clockwise or counterclockwise by the motor 38. Rotation of the link 50 causes the main lock lever 11 to from the unlocking position to the locking position and vice versa via the output cylinder 31.

An intermediate lever 56 is fixed at the support shaft 35 attached to the casing 27 in parallel to the center shaft 47. As shown in FIGS. 13 and 14, a roughly inversed L shaped hole 57 is formed at the intermediate lever 56 pin 60 formed at a right end 59 of a laterally long connector 58 is engaged with the inversed L-shaped hole 57. Another pin 69 is provided at the left end 68 of the connector 58. And the pin 69 is inserted through an axis hole 70 which is formed at the link 50. The roughly inversed L-shaped hole 57 comprises a changeover opening 61 extending radially relative to the support shaft 35 and a free play opening 62 centering around the support shaft 35. The pin 60 is usually maintained in such a state that it is engaged with an outer end 64 of the changeover opening 61 due to actions of a perturbation spring 63. Under this condition, the link 50 is linked with the intermediate lever 56 via the connector 58. The connector 58 and the hole 57 operate as an antitheft mechanism of the present invention.

Figure 16:
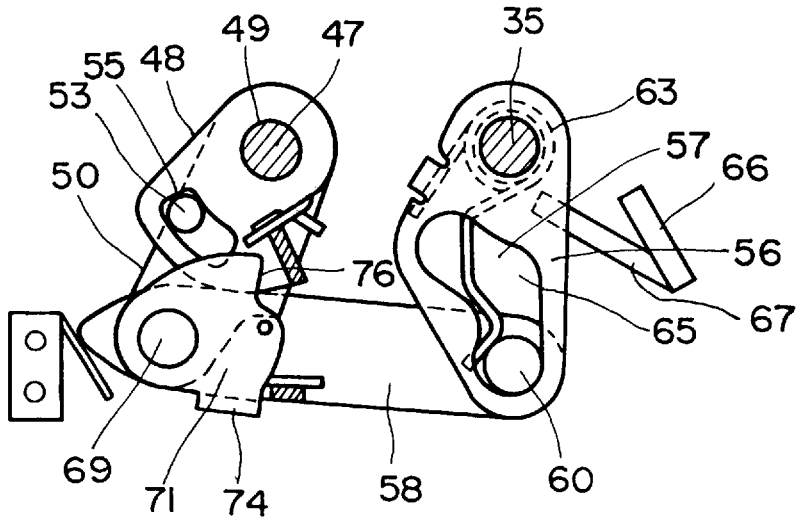
FIG. 16 is an arrangement view of a group of levers in the locked state.

FIG. 2 and FIG. 14 show the unlocked state. When in the unlocked state, as the inside lock button 36 is manually displaced into the locking side, the sub locking lever 26 and the intermediate lever 56 rotate clockwise together, thereby the connector 58 moves left to cause the link 50 to rotate clockwise. As the link 50 is linked with the output arm 25 via the output cylinder 31 clockwise rotation of, the output arm 25 causes the main locking lever 11 to be displaced to the locking position (FIG. 1, FIG. 16). Furthermore, as the link 50 in FIG. 14 is rotated clockwise, the projection 53 of the link 50 is brought into collision with the left end 55 of the arcuate hole 52 to cause the rotating lever 48 to rotate clockwise. However, as a clutch mechanism is provided between the rotating lever 48 and the motor 38, the motor 38 does not rotate. Further, as seen, in FIG. 2, when the main locking lever 11 is displaced to the locking position, the inside lock button 36 is displaced to the locking position due to the opposite procedure thereof.

As seen in FIGS. 11 and 14, an axis hole 72 of a change member 71 is rotatably inserted onto the pin 69. The change member 71 acts to change the antitheft mechanism to the antitheft state. The antitheft state according to the invention can be accomplished in the locked stated shown in FIG. 16 by shifting the pin 60 of the connector 58 from the outer end 64 of the changeover opening 61 to the inner end 65 thereof against the elasticity of the spring 63 (See FIG. 18). Furthermore, the state where the pin 60 is engaged with the outer end 64 thereof is expressed as a normal state or an antitheft cancelling state in the invention.

Figure 15:
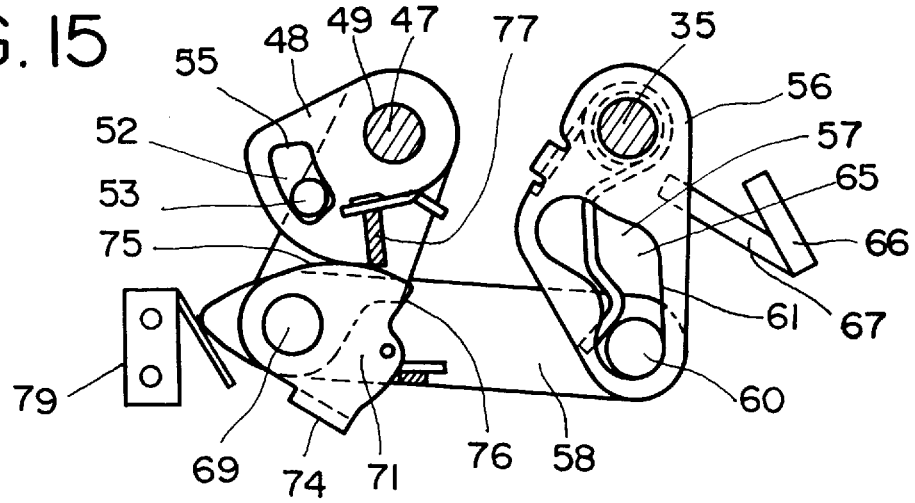
FIG. 15 is a view showing the state where the rotating lever is turned into the locking state from the state shown in FIG. 14.

The change member 71 is always energy-charged in the counterclockwise direction due to actions of a spring 73, and a folding piece 74 of the change member 71 is in contact with the connector 58. The change member 71 has a cam face 75 at the circumferential portion thereof and a wall 76 formed at the end portion of the cam face 75. In the unlocked state shown in FIG. 14, the cam face 75 is piled up together with a rotation locus of an engaging piece 77 of the rotating lever 48. However, the wall 76 is out of the rotation locus of the engaging piece 77. Therefore, in the unlocked state, as the rotating lever 48 is rotated clockwise (in the locking direction) by the motor 38, the engaging piece 77 of the rotating lever 48 comes in contact with the cam face 75. Then, the change member 71 is rotated clockwise against the elasticity of the spring 73. It is important that the clockwise rotation of the change member 71 does not cause the connector 58 to be rotated. Furthermore, as the rotating lever 48 rotates clockwise, the right end 78 of the arcuate hole 52 is engaged with the projection 53 to cause the link 50 to rotate clockwise. Then, the main locking lever 11 is changed over to the locking position by the rotation of the link 50, and the connector 58 moves leftwards as shown in FIG. 15. Hereupon, as the connector is turned into the state shown in FIG. 15, the output member 44 comes in contact with the stopper 85 to cause the rotation of the motor 38 to stop. Under this condition, in a case where the electric current to the motor 38 is interrupted, the rotating lever 48 is turned counterclockwise to an initial position by the elasticity of the spring 54. Hereupon, even though the rotating lever 48 returns to the initial position, the link 50 does not turn due to the lost motion formed by the hole 52 and projection 53. When the rotating lever 48 returns, the change member 71 is released from the rotating lever 48 and turns counterclockwise, by the elasticity of the spring 73, until the folding piece 74 comes in touch with the connector 58. This state is the locked state shown in FIG. 16.

Figure 17:
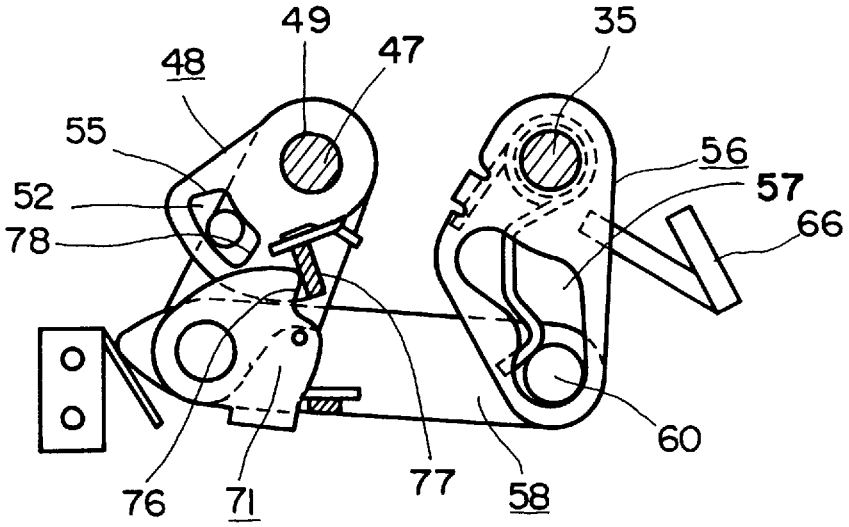
FIG. 17 is a view showing the state that the rotating lever is in contact with the change member with the rotating lever turned to lock from the state shown in FIG. 16.
Figure 18:
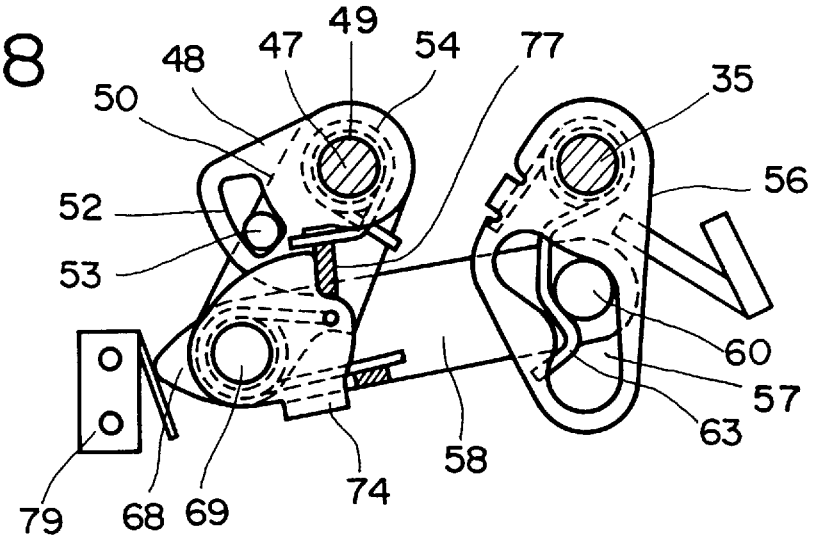
FIG. 18 is a view showing the state where the connector has moved to the antitheft position.
Figure 19:
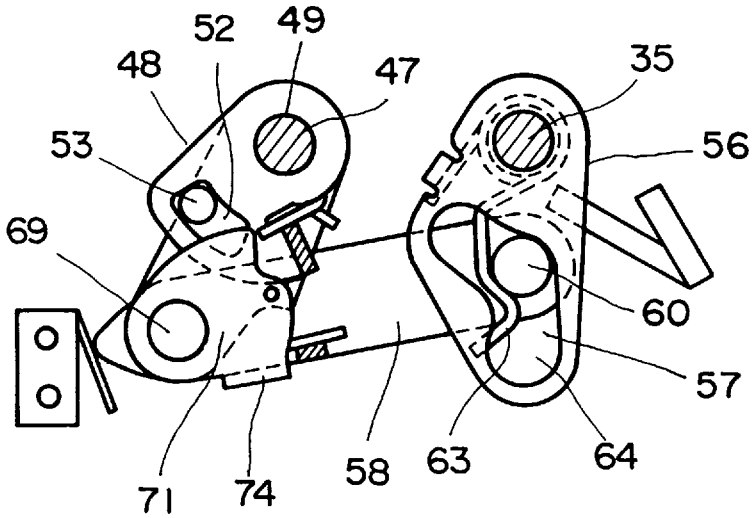
FIG. 19 is an arrangement view of a group of levers in the antitheft state.
Figure 20:
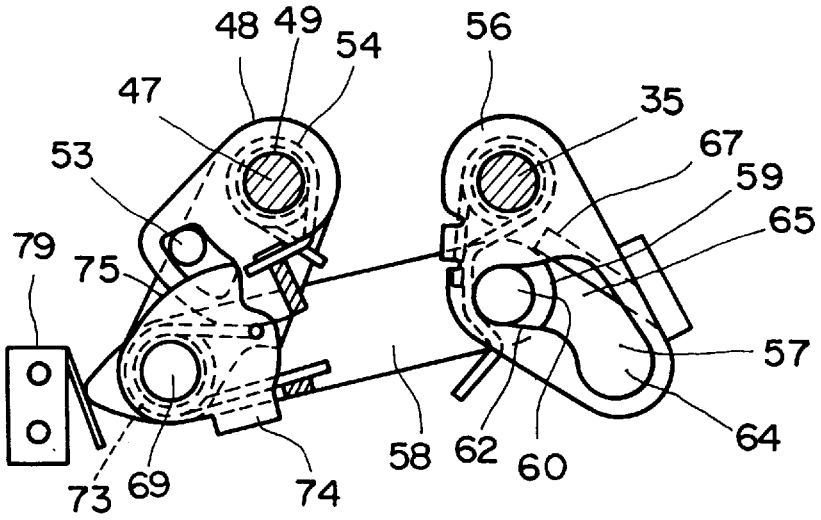
FIG. 20 is a view showing the state where the intermediate lever is caused to turn to unlock by the inside lock button in the antitheft state.

Although the wall 76 of the change member 71 is out of the rotating locus of the engaging piece 77 when unlocked, when it is being locked the wall 76 is aligned with the rotating locus of the engaging piece 77 as shown in FIG. 16. Therefore, as the rotating lever 48 is turned clockwise by the motor 38 while being locked, the engaging piece 77 is brought into contact with the wall 76 as shown in FIG. 17 to cause the change member 71 to be turned counterclockwise. Then, the folding piece 74 of the change member 71 causes the connector 58 to rotate around the pin 69. Therefore, the pin 60 is displaced from the outer end 64 of the changeover opening 61 to the inner end 65 thereof as shown in FIG. 18. As the pin 60 is positioned at the inner end 65 thereof, the antitheft mechanism is turned into the antitheft state. Thereafter, even though the intermediate lever 56 is turned counterclockwise by the inside lock button 36, it is impossible to shift the pin 60 with the actions of the free play opening 62. So, displacement of the main lock lever 11 is impossible. Furthermore, FIG. 19 shows the state that the rotating lever 48 is returned with the elasticity of the spring 54 with the current supply to the motor interrupted.

A guide plate 67 to cancel the antitheft function is integrally formed with the casing 27. As the link 50 is turned counterclockwise in the state shown in FIG. 19 to cause the connector 58 to move rightward, the guide plate 67 is brought into contact with the right end of the connector 58 to cause the connector to turn clockwise. Thereby, the pin 60 of the connector 58 is displaced to the outer end 64 of the changeover opening 61. A stopper 66 is formed integrally together with the casing 27. The stopper 66 is brought into contact therewith when the intermediate lever 56 is turned into the unlocked state. Hereupon, 79 is a switch to detect the antitheft position of the connector 58 when it is turned to this position.

Changing Operation to The Locking State

When the key cylinder 14 is turned to lock the vehicle door from the unlocked state shown in FIGS. 2 and 14, the main locking lever 11 is turned counterclockwise via a rod 15 to cause the connector 17 to move rightward. Thereby, a link 19 is displaced rightward around a pin 21, and a contacting piece 23 of the link 19 is separated from the ratchet pin 22 of the ratchet 83 and is turned into the locked state. At the same time, as the output arm 25 engages the main locking lever 11, the link 50 is turned clockwise around shaft 47 by the output cylinder 31 via the output arm 25.

Thus, the connector 58 moves leftward to cause the intermediate lever 56 to turn clockwise, as shown in FIG. 16, by engagement of the pin 60 with the change hole 61. Thereby, the sub locking lever 26 and inside lock button 36 are displaced toward a locked position.

Hereupon, even though the projection 53 pushes the left end 55 of the hole 52 by the rotation of the link 50 to cause the rotating lever 48 and output member 44 are caused to turn, the motor 38 does not rotate due to action of the clutch mechanism (See FIG. 6).

In a case of being displaced to the locked state by the inside lock button 36, the intermediate lever 56 is caused to turn via the sub locking lever 26 by the button 36 to make the connector 58 move leftward. Hereupon, the link 50, output cylinder 31 and output arm 25 integrally turn clockwise to cause the main locking lever 11 to be displaced to the locking position shown in FIGS. 1 and 16.

In a case of being displaced to the locked state by the motor 38, the output member 44 is turned via a group of reduction gears. Then, the center shaft 47 and rotating lever 48 integrally turn clockwise from the position shown in FIG. 14 and the engaging piece 77 of the rotating lever 48 is brought into contact with the cam face 75 of the change member 71, and the change member 71 is caused to turn clockwise against the elasticity of the spring 73 as shown in FIG 15. A the same time, the right end 78 of the arcuate hole 52 contacts the projection 53 to cause the link 50 to turn clockwise around pin 69. Thereby, the output cylinder 31 and output arm 25 integrally turn to cause the main locking lever 11 to be displaced to the locking position. And as the connector 58 moves leftward due to the rotation of the link 50, the intermediate lever 56 turns clockwise as shown in FIG. 15. In the state shown in FIG. 15, both the sub locking lever 26 and inside lock button 36 are integrally displaced to a locked position.

Hereupon, in the locked state, the output member 44 comes in contact with the stopper 85 and the motor 38 stops. As the motor 38 comes to a stop, the current supply to the motor 38 is interrupted. Then, the rotating lever 48 turns counterclockwise by the elasticity of the spring 54 until the left end 55 of the arcuate hole 52 comes in touch with the projection 53 as shown in FIG. 15, thereby causing the change member 71 to turn counterclockwise due to the elasticity of another spring 73. Then, the state shown in FIG. 16 is reached. A timer to measure the time duration to permit electric current to flow to the motor 38 or a switch to detect the locked state is used in order to interrupt the electric current to the motor 38. In the case of the present invention, even though the switch is damaged, the output member 44 can be only rotated to the locking position. Therefore, the displacement to the locked state can be carried out as usual.

Changing Operation to The Antitheft State

Before changing to the antitheft state, the lock unit is first moved to the locked state as shown in FIG. 1 and 16 by either of the methods described above. In the locked state, the motor 38 is given electric current to cause the output member 44 and rotating lever 48 to rotate clockwise. Then, as shown in FIG. 17, the engaging piece 77 of the rotating lever 48 is engaged with the wall 76 of the change member 71 to cause change member 71 to turn counterclockwise around the pin 69. Thereby, the folding piece 74 of the change member 71 causes the connector 58 to turn counterclockwise around the pin 69. Then, the pin 60 of the connector 58 is displaced from the outer end 64 of the changeover opening 61 to the inner end 65 thereof and the lock device is turned into the antitheft state shown in FIG. 18.

In the state shown in FIG. 18, as the output member 44 is brought into contact with the stopper 85, the motor 38 comes to a stop. After the motor 38 stops, the electric current to the motor 38 is interrupted, and the rotating lever 48 is turned counterclockwise by the elasticity of the spring 54 until the left end 55 of the arcuate hole 52 comes in touch with the projection 53 as shown in FIG. 19.

In this antitheft state, even though the intermediate lever 56 is turned counterclockwise by operating the inside lock button 36 to the unlocking side, the pin 60 of the connector 58 will not move due to actions of the free play opening 62. Therefore, even though the lock button 36 is directly operated with the window broken, the locking state will not be cancelled, and the door can not be opened.

Thus, with the present invention, the antitheft state is obtainable by rotating the motor 38 for the purpose of locking.

Cancelling The Antitheft State

Figure 21:
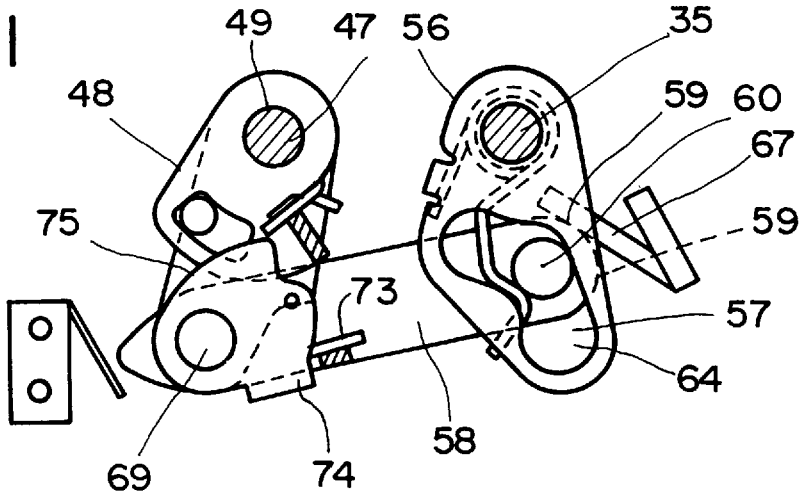
FIG. 21 and FIG. 22 are views showing the on-the-way states of the antitheft state.
Figure 22:
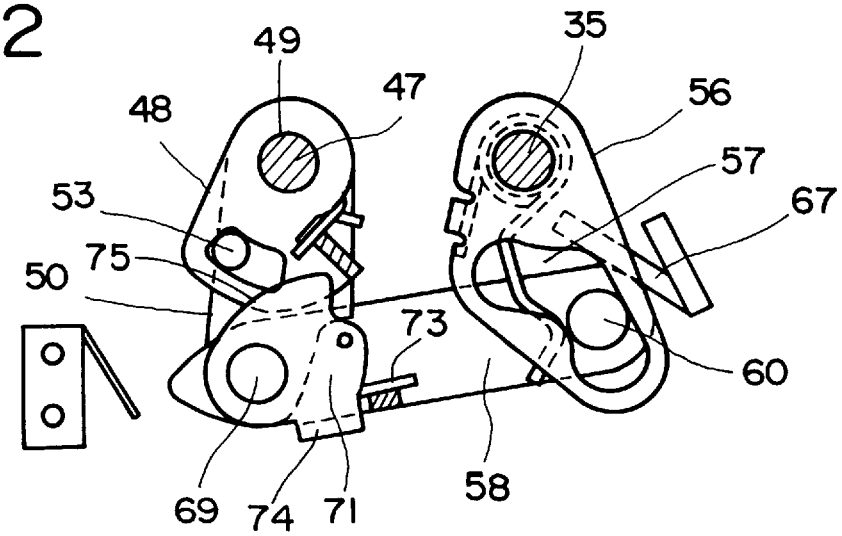
Figure 23:
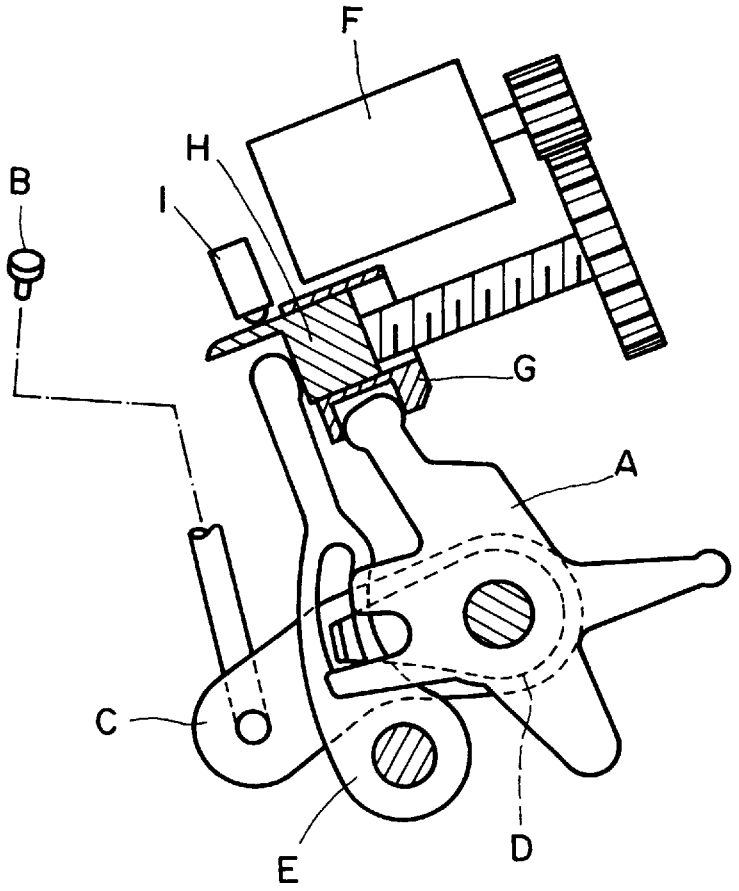
FIG. 23 (PRIOR ART)
FIG. 23 is a view showing an example already known to the public.

In order to cancel the antitheft state shown in FIG. 19, the link 50 is turned counterclockwise by the motor 38 or the key cylinder 14. Then, the connector 58 moves rightward, the right end 59 thereof is brought into contact with the guide plate 67 (Refer to FIG. 21), and the connector 58 is gradually turned clockwise by the guide plate 67 as the connector 58 moves rightward. Then, the state is turned into the state shown in FIG. 14 via the state shown in FIG. 22. Accordingly, the connector 58 is returned to the normal state, and at the same time, the main locking lever 11 is turned into the unlocked state.

What is claimed is:

1. A door locking device with an antitheft mechanism comprising:

a lock unit attached to the door, the lock unit having:

a latch engageable with a striker fixed to the vehicle body;

a ratchet engageable with the latch so as to maintain the engagement between the latch and the striker;

an open lever connected to an open handle of the door and for releasing the ratchet from the latch so as to open the door; and a main locking lever linked with a key cylinder of the door and displaceable between a locking position for disabling a door opening operation of the open lever and to an unlocking position for enabling the door opening operation of the open lever;

an actuator unit attached to the lock unit, the actuator unit having:

a substantially enclosed casing housing a first shaft, a second shaft which is in parallel to and spaced apart in the vicinity of the first shaft, and an antitheft mechanism which is provided between the first shaft and the second shaft, said antitheft mechanism being displaceable between an antitheft position in which the rotation of the second shaft is not transmitted to the first shaft and a normal position in which rotation of the second shaft is transmitted to the first shaft;

one end of the first shaft protruding outwards of the casing and being linked with the main locking lever;

one end of the second shaft protruding outwards of the casing;

a sub locking lever linked with an inside lock button of the door and fixed at the one end of the second shaft to rotate the second shaft in order to transmit rotation of said second shaft to the first shaft in the normal position;

a motor housed in the casing to rotate the first shaft in a locking direction and unlocking direction in order to displace the main locking lever and the antitheft mechanism;

wherein a first rotation of the motor rotating the first shaft in the locking direction precludes displacement of the antitheft mechanism to the antitheft position but causes the main locking lever to be displaced to the locking position.

2. A door locking device with an antitheft mechanism defined in claim 1, further comprising an output member linked with the first shaft so as to be rotated in the locking direction and the unlocking direction by the motor, a lost-motion slot provided between the output member and the main locking lever, and a spring biasing the output member in the unlocking direction, wherein when a first power causing the motor to have the first rotation is interrupted, the output member is rotated in the unlocking direction due to an elasticity of the spring by a distance equivalent to a length of the lost-motion slot.

3. A door locking device with an antitheft mechanism defined in claim 2, wherein after the first power is interrupted, a second rotation of the motor rotating the first shaft in the locking direction causes the antitheft mechanism to displace to the antitheft position.

4. A door locking device with an antitheft mechanism comprising:

a main locking lever connected to a key cylinder of a door to displace the locking device to a locking state and to an unlocking state by displacement between a locking position and an unlocking position;

a sub locking lever connected to an inside lock button of the door;

an antitheft member provided between the main locking lever and the sub locking lever, said antitheft member always linked with the main locking lever and displaced to a normal position establishing a normal state where the antitheft member is linked with the sub locking lever and to an antitheft position establishing an antitheft state where the antitheft member is not linked with the sub locking lever;

an output member rotated by a motor in a locking direction and an unlocking direction displacing the main locking lever between the locking position and the unlocking position; and a guide plate provided in a vicinity of the antitheft member and engageable with the antitheft member to displace the antitheft member from the antitheft position to the normal position when the main locking lever is displaced into the unlocking position;

said guide plate being fixed to a stationary casing member of the locking device.

5. A door locking device with an antitheft mechanism defined in claim 4, further comprising a change member provided between the output member and the antitheft member, wherein the change member is engaged to the output member and displaces the antitheft member to the antitheft position from the normal position when the output member is rotated in the locking direction when in the locking state.

6. A door locking device with an antitheft mechanism defined in claim 5, further comprising a lost-motion provided between the output member and the main locking lever, and a spring for biasing the output member in the unlocking direction, wherein the output member is not substantively engaged with the change member even though the output member is rotated in the locking direction by the motor under the unlocking state, and as the power to the motor for rotating the output member in the locking direction is interrupted upon a completion of the locking state, the output member is rotated in the unlocking direction by a distance equivalent to the lost-motion by the elasticity of the spring.

7. A door locking device for a door having an opening handle, a key cylinder and an inside lock button comprising:

a locking lever connected to the key cylinder and displaceable between an unlocking position where the door can be opened with the opening handle and a locking position where the door cannot be opened with the opening handle;

an antitheft member displaceable between a normal position wherein the locking lever can be displaced from the locking position to the unlocking position by actuation of the inside lock button and an antitheft position where the locking lever cannot be displaced from the locking position to the unlocking position by actuation of the inside lock button;

a motor for displacing the positions of the locking lever and the antitheft member;

a transmission coupling the motor to the locking lever, said transmission having a mechanically defined end portion which is brought into contact with a stationary casing member of the locking device, when the motor is rotated in a locking direction, to limit further locking rotation of the motor;

a movable member driven by the motor and engageable with the antitheft member, when the locking lever is in the locking position and the motor is rotated in the locking direction to displace the antitheft member into the antitheft position;

a first spring for returning the movable member in an unlocking direction when electric current for rotating the motor in the locking direction is interrupted;

wherein when said motor is rotated in the locking direction while the locking lever is in the unlocking position, the locking lever is displaced into the locking position and the end portion is brought into contact with the stationary casing member;

wherein when the electric current for rotating the motor in the locking direction is interrupted, the movable member moves in the unlocking direction by the resilient force of the first spring;

wherein when said motor is rotated in the locking direction while the locking lever is in the locking position, the antitheft member is displaced into the antitheft position by the engagement with the movable member.

8. A door locking device defined in claim 7, further comprising a second spring for holding the antitheft member in either one of the normal position an the antitheft position.

* * * * *